US005878922A

United States Patent [19]

Boring

[11] Patent Number: 5,878,922

[45] Date of Patent: Mar. 9, 1999

[54] SELF VENTING PLUNGER

[75] Inventor: David E. Boring, East Berlin, Pa.

[73] Assignee: Sunoco Products Company, Hartsville, S.C.

[21] Appl. No.: 890,412

[22] Filed: Jul. 9, 1997

[51] Int. Cl.[6] ..... B67D 5/42

[52] U.S. Cl. ..... 222/387; 222/386

[58] Field of Search ..... 227/327, 386, 227/387

[56] References Cited

U.S. PATENT DOCUMENTS

| | | | |
|---|---|---|---|
| 2,755,003 | 7/1956 | Sherbondy | 222/327 |
| 4,819,836 | 4/1989 | Meckenstock | 222/386 |
| 4,951,848 | 8/1990 | Keller | 222/386 |
| 4,966,468 | 10/1990 | Bruning | 222/386 |
| 5,042,695 | 8/1991 | Battegazzore | 222/386 X |
| 5,150,823 | 9/1992 | Sugita | 222/386 |
| 5,178,305 | 1/1993 | Keller | 222/386 |
| 5,316,186 | 5/1994 | Prestele | 222/327 |
| 5,377,880 | 1/1995 | Moretti | 222/387 X |
| 5,400,926 | 3/1995 | Keller | 222/327 |

*Primary Examiner*—Kenneth Bomberg
*Attorney, Agent, or Firm*—Dennison, Meserole, Pollack & Scheiner

[57] ABSTRACT

A self-venting cartridge plunger including openings defined therein and forming through air passages, each opening having an associated valve flap hinge-joined to the plunger and movable to close the opening upon the plunger encountering a greater resistance to movement than the flow of evacuating air.

15 Claims, 2 Drawing Sheets

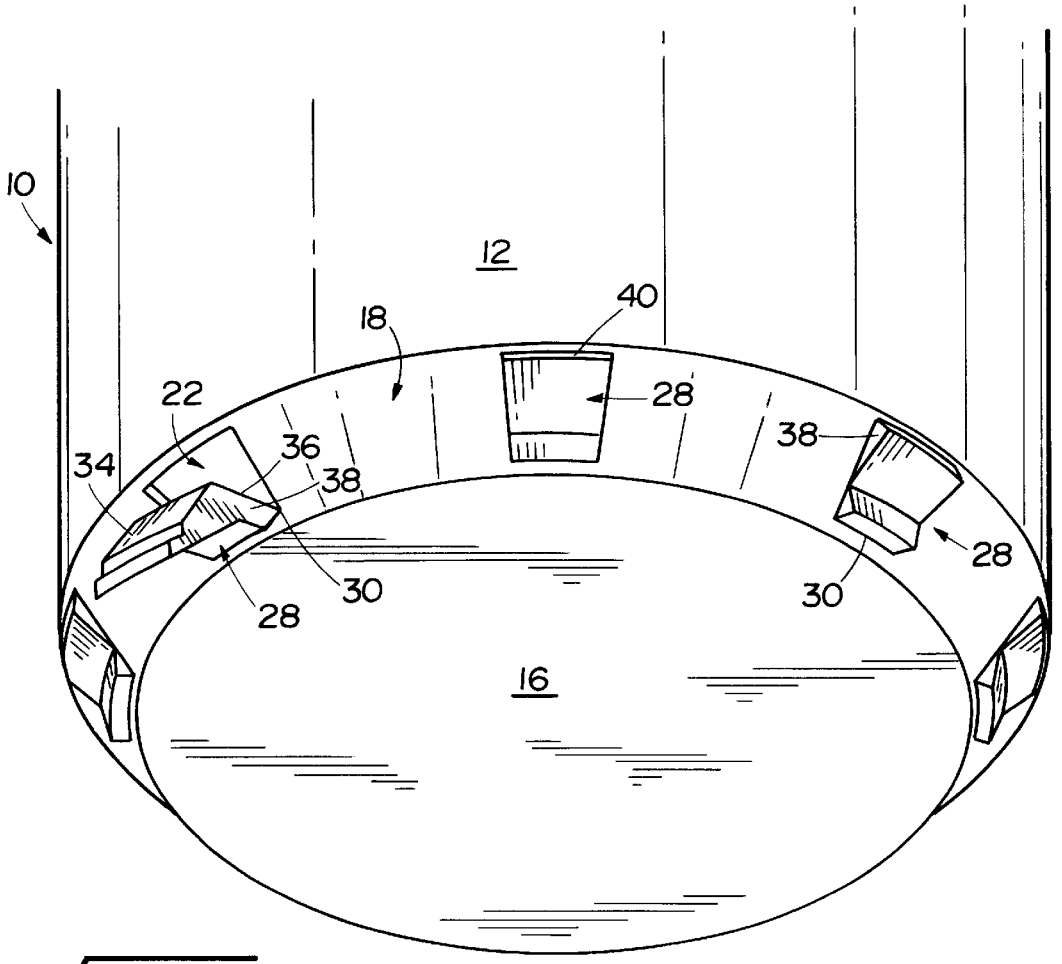
FIG. 1
FIG. 2
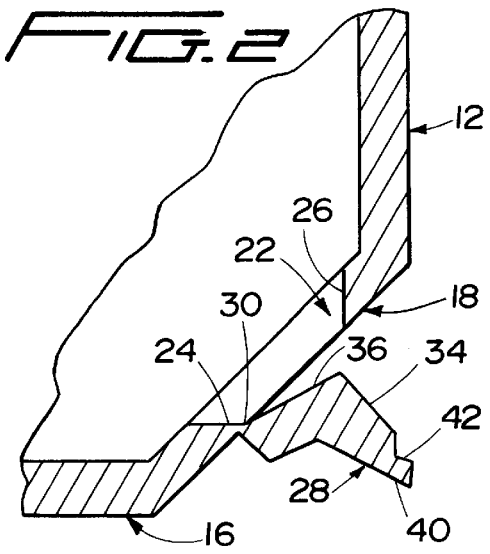
FIG. 3
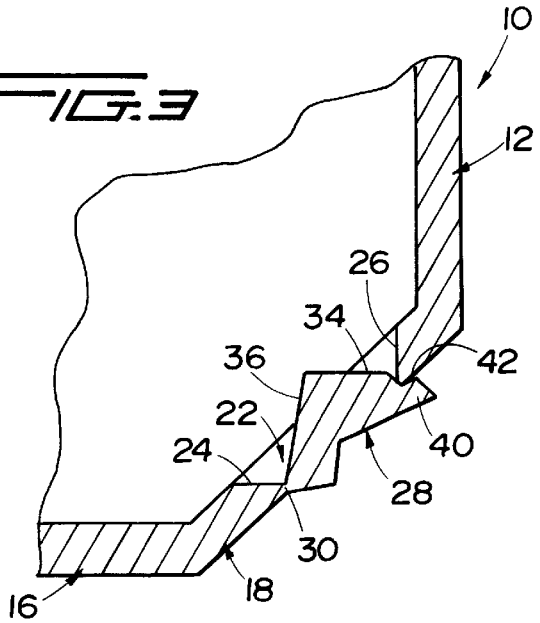

SELF VENTING PLUNGER

BACKGROUND OF THE INVENTION

The invention is broadly concerned with dispensing cartridges for viscous materials, particularly caulk, and more specifically involves plungers for such cartridges.

When filling caulk cartridges, it is common practice to close the cartridges by inserting a molded plastic plunger after the cartridge has been filled with the caulk material. It is desirable not to trap air in the cartridges during this operation, and a number of methods are currently used to address this concern. Vacuum may be used to draw air out of the cartridge prior to inserting the plunger. This method is effective, but time consuming. An alternate method utilizes a pin or spade-like device inserted between the cartridge wall and the plunger to create a temporary passage through which the air may escape as the plunger is inserted. Because of contamination by the caulk, it is necessary to stop this operation frequently and clean the pin or spade. A third method, attempts to distort the cartridge or plunger during insertion thereby creating an escape path for potentially entrapped air. This method is effective in removal of a large proportion of air, but frequently fails to allow the escape of all entrapped air.

A recent advance involves the incorporation of longitudinal ridges, either in the cartridge wall or plunger wall. These ridges function much as the pin or spade method, creating a passage between the cartridge and plunger through which air may escape. However, if the material is to be protected to provide a reasonable storage or shelf life in the cartridge, the ridges must not extend the full length of the plunger. There must result then, a compromise between extending shelf life and full evacuation of entrapped air.

SUMMARY OF THE INVENTION

It is a primary object of the present invention to provide for the complete evacuation of air from the cartridge, in conjunction with a positive sealing of the contents of the cartridge against air contamination which could cause premature drying and a reduction in shelf life.

It is also of significance that the air evacuation be achieved automatically and as a normal consequence of the insertion and positioning of the unique plunger of the invention without requiring ancillary equipment or procedures.

In achieving these objects, it is also significant that substantial economies are achieved both in the formation of the plunger, which is basically a unitary product molded much in the manner of a conventional plunger, and in the manner of use, particularly in the initial mounting thereof and positioning in an air-tight manner with the contained material.

The plunger of the invention is preferably of a one-piece molded synthetic resinous material with a leading face or bottom panel adapted to engage and forcibly eject the material as the plunger is driven forwardly by an appropriate pusher assembly. The plunger includes a circular body wall sealed to and guidingly engaged with the interior surface of the cartridge, and an inclined or conical section between the bottom panel and wall peripherally about the plunger. The conical section, which will also engage the material within the cartridge, is provided with a series of air-venting openings at spaced points peripherally thereabout and allowing for the free discharge of contained air as the plunger is advanced toward the material. Each vent opening is provided with an integral vent flap joined by a living hinge to the lowermost edge of the opening and angled upwardly and outwardly away from the opening to provide for the free flow of air thereabout and through the opening. The normal or at rest position of each valve flap is its open position remote from the corresponding opening. The flap will retain this position as long as no resistance greater than air flow is encountered as the plunger moves inwardly. In fact, one of the purposes of providing multiple openings is to ensure that there is no air pressure build-up such as might move the flaps.

Upon encountering a resistance to inward movement greater than that of the flow of expelling air, that is upon encountering of the enclosed dispensing material, the viscosity of which substantially exceeds any minimal viscosity or air resistance, the valve flaps will pivot about the living hinges, overcoming the inherent memory of the material and resistance to movement, to overlie and close the openings. In this manner, there will be no escape of the material through the vent openings. Equally important, the material will be sealed from the atmosphere to preserve the nature thereof, preventing premature hardening and extending the shelf life. In order to provide an effective seal, each of the valve flaps includes a wedge configuration which effectively engages within the opening and progressively seals the opening peripherally thereabout as the pressure increases.

Further features, objects and advantages of the invention will be noted from the more detailed explanation thereof following hereinafter.

BRIEF DESCRIPTION OF THE DRAWINGS

FIG. 1 is a bottom perspective view of the plunger of the invention illustrating several of the multiple vents formed therein; for purposes of illustration only, one has been shown as open and the others as closed;

FIG. 2 is a cross-sectional detail through the plunger with a valve flap in its open position;

FIG. 3 is a cross-sectional detail similar to FIG. 2 with the valve flap closed;

DESCRIPTION OF PREFERRED EMBODIMENT

Figure 4:
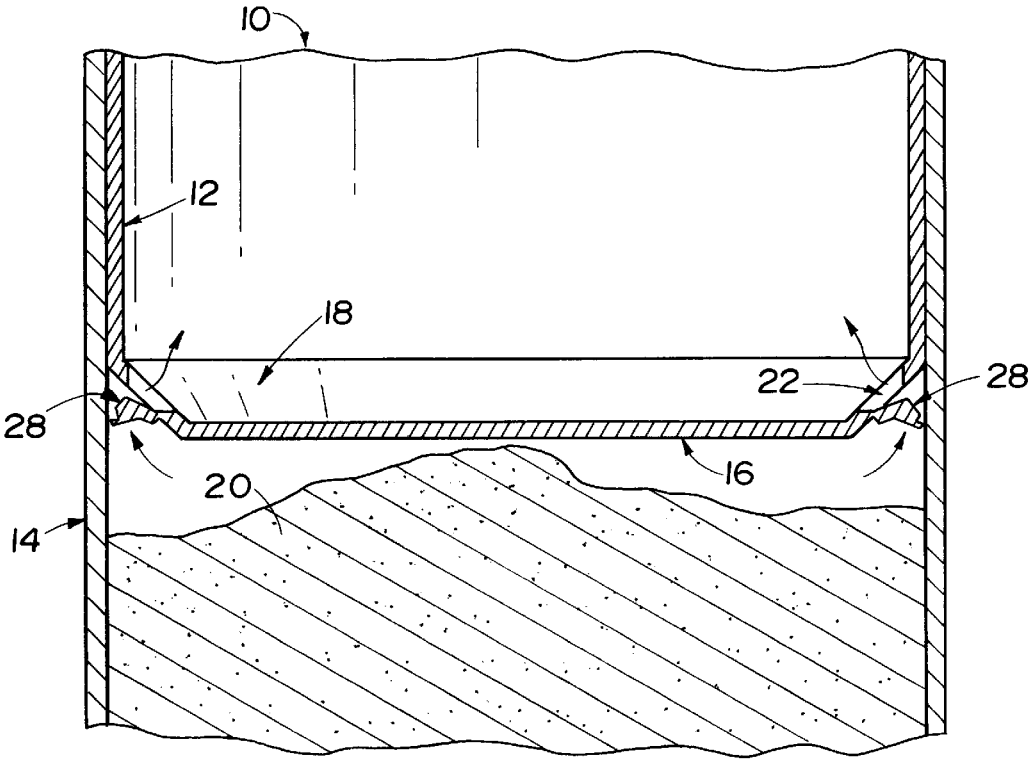
FIG. 4 is a cross-sectional detail through a cartridge as the plunger is advanced to exhaust the air.
Figure 5:
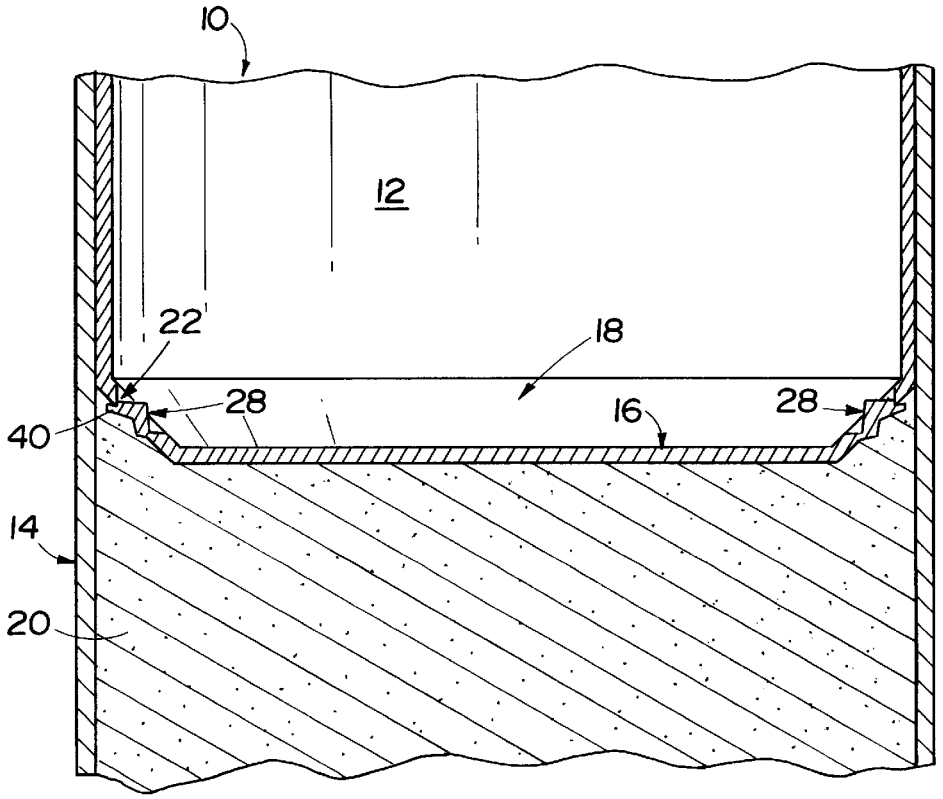
FIG. 5 is a cross-sectional view similar to FIG. 4 with the plunger contacting the dispensing material and the valve flaps closed -n reaction to contact therewith.

Referring now more specifically to the drawings, the plunger 10 of the invention, preferably formed as a unitary member of an appropriate synthetic resinous material, includes a cylindrical body wall 12 adapted to slidably engage and provide an effective seal with the interior surface of a cartridge body 14.

The plunger further includes a leading face or end panel 16 of a diameter less than that defined by the plunger wall 12 and integrally joined to the lower edge of the wall 12 by an annular conical section 18. The panel 16 can be of any appropriate configuration in accord with the material 20 to be dispensed and the nature of the plunger positioning means and pusher assembly used to forwardly drive the plunger and expel the material.

As the plunger 10 is initially inserted into a filled cartridge, it is essential that trapped air between the cartridge leading panel 16 and the material be properly and completely evacuated. Pursuant thereto, a series of venting openings 22 are provided through the conical section 18 peripherally thereabout. While probably not particularly practical, one or two relatively large openings can be provided. However, multiple openings to equalize the air flow and minimize air pressure is much preferred. As one example, eight equally spaced openings 22 can be provided, each extending along an arc of approximately 13°. The openings are generally rectangular or slightly trapezoidal with the lower edge 24, that edge closest to the bottom panel 16, being slightly shorter than the upper edge 26 immediately inward of the lower edge of the cylindrical wall 12. These edges as well as the opposed side edges are preferably inwardly undercut.

The openings 22, and in particular the combined flow area defined by multiple openings 22 provides for an effective expelling of the trapped air as suggested in FIG. 4 wherein air movement is defined by the direction arrows. However, upon engagement of the plunger 10 with the material 20 to be dispensed, it is essential that the openings be closed. Pursuant thereto, each opening 22 is provided with a valve flap 28 integrally formed with the conical section 18 by a living hinge 30 along and co-extensive with the lower edge 24 of the opening 22. Each valve flap 28 in its at rest position, that is under insufficient external pressure to move to a sealed position relative to the corresponding opening 22, extends downwardly and outwardly relative to the corresponding opening 22 to allow for the desired free flowing air discharge. It is only upon a complete evacuation of the air and an engagement of the valve flaps with the material 20 to be dispensed, and the greater viscosity thereof, that sufficient pressure is exerted on the valve flaps to move these flaps to closed positions within the openings 22, thus preventing discharge of the material 20 and an air-tight seal of the material within the cartridge tube 14.

Noting the details of the valve flaps 28, it will be seen that these flaps 28, in the open position thereof, are inwardly offset from the outer face of the plunger side wall 12 so as to avoid any interference with the inner surface of the cartridge tube 14 or with the sealing of the side wall to this inner surface as the plunger moves therein.

In order to provide a highly effective sealing of each of the openings 22, the valve flaps 28 are of a wedge-shaped configuration having an outer face slightly larger than the openings, an inwardly directed body defined by upper and lower angled or tapered faces 34 and 36, and, as desired, similarly tapering side faces 38 which engage, in the manner of a wedge, with the edges of the corresponding opening 22 in a progressively tighter and more effective sealing manner as the valve flaps move to a fully seated position within the openings. Noting FIG. 3 in particular, it will be seen that inward movement of each valve flap is limited, with the fully seated position of the flap being defined by a lip portion 40 along the free edge of the valve flap 28 remote from the living hinge 30. This lip portion 40 extends beyond the upper tapered face 34 to define a retaining shoulder 42 and, as illustrated, will overlie the conical section 18 immediately above the opening 22. With the valve flaps fully seated, the cartridge tube is effectively sealed with the initially entrapped air removed and the dispensing material effectively isolated from ambient air.

From the foregoing, it will be appreciate that the plunger of the invention is unique in its ability to provide for an effective evacuation of entrapped air and a subsequent air-tight sealing of the cartridge contents in a simple but highly distinctive manner, neither utilizing nor requiring any means external to the unitary molded plunger structure itself.

The foregoing is considered illustrative of the features of the invention, and obvious variations thereof as may occur to one skilled in the art, as for example in the specific configuration of the openings and valve flaps, are to be considered within the scope of the invention and the claims following hereinafter.

I claim:

1. A self-venting plunger for use in the dispensing of viscous material contained within a dispensing tube, said plunger comprising a leading panel, a peripheral wall integral with and extending rearward of said leading panel, at least one vent opening defined through said plunger forward of said peripheral wall and defining an air path through said plunger for free discharge of air therethrough as said plunger is moved inwardly within a dispensing tube toward contained viscous material, and a valve flap mounted on said plunger and movable between a forward open position remote from said at least one opening for free flow of air thereby and through said at least one opening, said valve flap being selectively movable to a second closed position closing said at least one opening upon encountering resistance to inward movement of said plunger greater than that of an air flow thereby.

2. The self-venting plunger of claim 1 wherein said valve flap is integral with said plunger with a living hinge defined therebetween, said living hinge having an inherent memory retaining said valve flap remote from said opening until encountering a predetermined resistance to forward movement of said plunger.

3. The self-venting plunger of claim 2 wherein said plunger includes a conical section integrally defined between said leading panel and said peripheral wall, said at least one opening and said valve flap being formed within said conical section rearward of said leading panel and within peripheral confines defined by said peripheral wall.

4. The self-venting plunger of claim 3 wherein said at least one opening comprises multiple duplicate at least one openings at peripherally spaced points about said conical section, each of said openings having a valve flap associated therewith and duplicating said first mentioned valve flap.

5. The self-venting plunger of claim 4 wherein each valve flap has a wedge-shaped face thereon forcibly received and progressively sealing within the associated opening upon movement of said valve flap to said closed position.

6. The self-venting plunger of claim 5 including lip means on each of said valve flaps limiting inward movement thereof in an associated opening.

7. The self-venting plunger of claim 2 wherein said at lesat one opening comprises multiple duplicate openings at peripherally spaced points about said plunger, each of said openings having a valve flap associated therewith and duplicating said first mentioned valve flap.

8. The self-venting plunger of claim 1 wherein said plunger includes a conical section integrally defined between said leading panel and said peripheral wall, said at least one opening and said valve flap being formed within said conical section rearward of said leading panel and within peripheral confines defined by said peripheral wall.

9. The self-venting plunger of claim 8 wherein said at least one opening comprises multiple duplicate openings at peripherally spaced points about said conical section, each of said openings having a valve flap associated therewith and duplicating said first mentioned valve flap.

10. An air-venting plunger for a dispensing tube for viscous materials, said plunger comprising a leading face and a peripheral wall extending rearward from said leading face for a plunger-guiding engagement within a dispensing tube with said leading face forwardly directed for selected movement into dispensing engagement with a tube-contained viscous material, air venting means in said plunger for unencumbered air flow rearwardly through said plunger relative to said leading face upon forward movement of said plunger, valve means adjacent said venting means for closing said venting means, and means both for retaining said valve means in an open position remote from said venting means for allowing air flow through said venting means, and for allowing movement of said valve means to a closed position closing said venting means upon encountering a material of greater resistance to flow than air.

11. An air-venting plunger as in claim 10 wherein said venting means comprises at least one opening through said plunger, said valve means comprising a valve flap associate with said at least one opening, said means both for retaining said valve means in an open position and allowing movement of said valve means to a closed position comprising a living hinge integrally joining said valve flap to said plunger and having an inherent memory retaining said valve flap in said open position while allowing for selected movement of said valve flap to said closed position in accord with resistance encountered to forward movement of said plunger.

12. An air-venting plunger as in claim 11 wherein said plunger includes an integral conical section between said leading face and said peripheral wall, said at least one opening and said valve flap being formed within said conical section.

13. An air-venting plunger as in claim 12 wherein said valve flap includes a wedge-shaped face thereon progressively engageable within and sealing said opening in said closed position.

14. An air-venting plunger as in claim 13 wherein said at least one opening comprises multiple openings at peripherally spaced points about said conical section, and duplicate valve flaps, one associated with each opening and integrally joined to the plunger by a living hinge.

15. An air-venting plunger as in claim 12 wherein said at least one opening comprises multiple openings at peripherally spaced points about said plunger, and duplicate valve flaps, one associated with each opening and integrally joined to the plunger by a living hinge.

* * * * *

UNITED STATES PATENT AND TRADEMARK OFFICE

CERTIFICATE OF CORRECTION

PATENT NO. : 5,878,922

DATED : March 9, 1999

INVENTOR(S) : David BORING

It is certified that error appears in the above-indentified patent and that said Letters Patent is hereby corrected as shown below:

On the title page, item [73], the assignee should read --Sonoco Products Company, Hartsville, S.C.--.

Signed and Sealed this

Twentieth Day of July, 1999

*Attest:*

*Attesting Officer*

Q. TODD DICKINSON

*Acting Commissioner of Patents and Trademarks*